United States Patent [19]

Drasche

[11] 4,386,455

[45] Jun. 7, 1983

[54] BEARINGS FOR PIANO ACTION MECHANISM EMPLOYING BUSHING CLOTH AND METHOD OF FABRICATING SAME

[75] Inventor: Walter G. Drasche, Long Island City, N.Y.

[73] Assignee: CBS, New York, N.Y.

[21] Appl. No.: 274,015

[22] Filed: Jun. 15, 1981

[51] Int. Cl.[3] ..... B21D 53/10

[52] U.S. Cl. ..... 29/149.5 S; 29/149.5 NM; 264/127; 264/128; 384/125; 384/298; 384/300

[58] Field of Search ..... 29/149.5 NM, 149.5 S; 308/238, 239, DIG. 7; 264/127, 128; 384/185

[56] References Cited

U.S. PATENT DOCUMENTS 2,580,436 1/1952 Knoblaugh ..... 29/149.5 NM
2,580,437 1/1952 Knoblaugh ..... 29/149.5 NM
2,580,438 1/1952 Knoblaugh ..... 384/125
2,641,828 6/1953 Knoblaugh ..... 29/149.5 NM

*Primary Examiner*—Lowell A. Larson
*Assistant Examiner*—V. K. Rising
*Attorney, Agent, or Firm*—Spencer E. Olson

[57] ABSTRACT

A piano action mechanism wherein a shaft pin for rotatably supporting a rotatable member on a flange is carried in bearings formed of bushing cloth glued to the surface of bushing holes in the rotatable member. With a pin inserted through the cylinders of bushing cloth, the assembly is dipped in water, dried, dipped in a solution of resin bonded fluorocarbon solids, again dried and the pin removed, to provide a durable and stable bearing having a low coefficient of friction and which is essentially noise-free and insensitive to changes in temperature and humidity.

6 Claims, 5 Drawing Figures

BEARINGS FOR PIANO ACTION MECHANISM EMPLOYING BUSHING CLOTH AND METHOD OF FABRICATING SAME

BACKGROUND OF THE INVENTION

This invention relates to bearings, and more particularly to pin bearings, such as are used in the pivotal connections in a piano action; that is, the centers on which the wooden action members pivot.

The pivotal connections in a piano action must be durable, low in friction yet firm, have with little sideplay, and be quiet in operation. These connections are usually effected with a tongue-and-fork arrangement held together by means of a lateral or transverse pin, usually made of "nickel silver" to eliminate corrosion, and are manufactured to precise tolerances as to diameter, length, and concentricity. The pin is held firmly in the central or tongue member, and the fork member is provided with a bushing with a view toward achieving a noiseless, efficient and durable action.

For many years the bearings, or bushings, for these centers have been formed from a woven wool cloth, a special all-wool felted fabric especially designed and manufactured for the purpose (known in the art as bushing cloth) by a number of manual operations. The cloth is first dipped in water to allow it to shrink and after drying is severed into strips of a width somewhat less than the circumference of the bushing holes. The strips thus formed are then pulled through the holes of the bearing-containing parts, such as the bifurcated fork element having axially aligned bearing holes in its bifurcations, the cloth becoming circumferential in the bearing holes. Glue is then applied to the cloth along one outboard side of the bifurcated member, and the member then pulled over the glue-wetted portion. The member is then cut away from the cloth strip at the outer faces of its bifurcations, and the length of the strip between the bifurcations is also cut away and discarded; thus, only a small portion of the bushing cloth is used.

The wool felted fabric has sufficient resiliency and softness to substantially eliminate noises, but to be durable and firm, the bearing must be dense. Furthermore, the bushing holes in the bearings must be aligned for low friction operation of the shaft or center pin placed therein. Heretofore, the problems of durability and smooth operation have been addressed by employing a wool felt which is initially much thicker than its ultimate dimension in the bearing, and then carrying out the further manual operations upon the cloth glued in the member as described above. To provide openings for the center pin, the tight cylinders of bushing cloth in a bearing member, after the glue holding them therein has hardened, are opened preliminarily along the axis of the bearing formation. Following this a metal pin of the diameter of the center pin is driven with a forward motion into the preliminary opening, radially compressing the cloth cylinders to a considerably denser condition. With the rod inserted, the assembly is then dipped in water for a short time to permit the wool cloth cylinders to absorb moisture, and the assembly is allowed to dry before removing the pin. Wool of course absorbs water appreciably and if unopposed will swell with moisture absorption. However, under the described confined condition the wool cylinders are substantially prevented from altering their dimensions due to moisture absorption, and are, therefore, forced to a denser condition and upon drying are "set" to this condition.

Finally, upon removal of the metal pin the assembly is ready for use in a bearing combination, with center pin holes in the wool cylinders formed to a size adapted to a particular metal center pin and in alignment brought about by the straight compression pin.

Although bearings fabricated as described have proven to have resilience and softness sufficient to eliminate noises, and appropriate density to be durable and firm under the impacts imposed in the playing of a piano, under continued use in certain atmospheric conditions the bearing tends to deteriorate, with attendant loss of its desirable properties. The felted wool being hygroscopic, it tends to swell in moist atmospheric conditions and to shrink in dry conditions. Consequently, under moist conditions the center may become so tight as to interfere with the functioning of the pivotal connection, and the corresponding piano key either loses all speed and sensitivity of action or fails to function entirely. A common "fix" for malfunctions due to tightening of the center because of high humidity is the application of a drop of a solvent such as benzene, or an alcohol and water mix, which usually relieves the pivot only temporarily in that it tends to tighten up again with continued exposure to moist conditions. Conversely, with dry conditions the centers occasionally become too loose, resulting in rattles in the action and inaccuracy in the alignment of parts, with consequent loss of power and control in the so-called "touch qualities" of the action.

Over the years there have been many attempts to improve the bearings of piano actions, either by use of materials other than felted wool for the bushing or by simplifying and reducing the cost of the labor-intense fabrication of the centers. For example, Knoblaugh U.S. Pat. Nos. 2,580,436, 2,580,437 and 2,580,438 describe bearing assemblies in which the bushing is in the form of a braided tubular sleeve comprised of many braid elements in the form of cords, tight yarns, or thread which may be textile material such as wool or silk, but preferably nylon thread. A braided sleeve of appropriate size is placed under tension and coated with a material of a type which dries and hardens to a suitable tensile strength, such as a nitrocellulose lacquer cement applied in an amount such that upon drying the completed tube has an outside diameter such that tube fits snugly in a bearing hole in the bifurcated bearing member. Thus, the prepared bearing material comprises a stiff tube which may be pushed into a bearing hole, and as part of the assembly operation a cement is applied to the external surface for attaching the bearing material to the wood bifurcated member of the action.

Another approach, which has been used by applicant's assignee for several years, was to eliminate the use of bushing cloth altogether and replace it with a one-piece bushing formed of a suitable plastic or elastomeric material, such as Teflon. The bushing has an intergral annular flange at one end which bears against the internal or tongue side of each arm of the bifurcated member, and is inserted from the inside into a bushing hole of correct size to afford a light push fit, so as to eliminate any possible distortion of internal diameters. An initial version of this type of bushing is described in U.S. Pat. No. 3,240,095, and a refinement thereof wherein the exterior surface of the bushing has a "barrel shape" to provide self-alignment of the bushing with the bearing pin regardless of misalignment of the bushing holes in the respective fork arms, is described in U.S.

Pat. No. 3,942,403. Although the performance of piano actions with this type of bushing has been sufficiently good to have been used in preference to bushing cloth for some twenty years by applicant's assignee, this long-term experience has demonstrated that it is not without fault, and lacks some of the desirable properties of wool felt. For example, in spite of observance of usual care in the fabrication of the wooden parts of the piano action, the drilled holes in the two fork arms may not be perfectly aligned, or may be misaligned with the drilled pin-receiving hole in the tongue part, with the consequence that the internal bores of the two bushings, when inserted with a push fit in the drilled holes in the fork arms, are likewise misaligned with the bearing pin, thus causing the pin to bind in the bushing and not rotate with the desired ease. This problem is compounded by the sizing of the bushing relative to the size of the holes in the fork arms to afford a light push fit, so as to eliminate any possible distortion of the internal diameter of the bushing and to increase the effective length of the contact between the bearing pin and the internal bore of the bushing. Also, it has been found difficult to maintain the clearance between mating wood parts to tolerances sufficient to allow the center to work freely when the wood parts are distorted by extreme conditions of moisture and/or temperature; under certain conditions there is an excess of freedom which causes the action to be noisy, and under other conditions the pin tends to bind in the bushing and does not rotate with the desired ease. In short, although the one-piece bushing reduces the labor cost of manufacture of the piano action and under favorable operating conditions provides acceptable performance, under other conditions it lacks the desirable qualities of the long-used wool bushing cloth.

Other piano manufacturers have continued to use felt bushings in their piano actions, modified in various ways to obviate some of the problems discussed earlier. For example, the surface of the felt ring has been coated with silicone or impregnated with suds or soapy water to reduce friction between the bushing and bearing pin; however, a bearing assembly of this construction has the drawback that it will lose lubricity during long use. U.S. Pat. No. 3,730,963 proposes as a solution to this problem the use of a bushing cloth consisting of a fabric woven from mixed spun yarns of wool fibers and carbon fibers which are napped on the surface of the fabric to provide high and long-term lubricity.

In view of the virtues of wool felt as a bushing in a piano action, as demonstrated by its use over a very extended period, albeit not without the weaknesses and shortcomings outlined above, the present invention seeks to provide bearings utilizing wool felt which in some respects simplifies their fabrication as compared to the existing practices outlined above and which has considerably improved bearing qualitities which are maintained during long use and exposure to a wide range of atmospheric conditions. Accordingly, the object of this invention is to provide a construction and method of fabricating the same for supporting the rotatable parts of a piano action mechanism which retains the desirable qualities of wool felt as a bushing material during long use, which is minimally affected by changes in atmospheric conditions, and which retains a desired lubricity during long use.

SUMMARY OF THE INVENTION

In general, the piano action mechanism according to the invention comprises a bifurcated support member having a pair of parallel fork arms provided with mutually facing bushing holes, and defining a hollow space therebetween; a rotatable tongue member disposed in the hollow space of the fork member and provided with a shaft pin passing through the bushing holes in the fork member; and fabric bushings in the bushing holes, preferably formed of felted wool cloth with at least its working surface incorporating particles of a fluorocarbon polymer, such as Teflon.

According to one aspect of the fabrication method, one surface of a sheet of felted wool bushing cloth is thinly coated with a heat-sensitive glue of a type that dries and remains dry (i.e., is not tacky) until heated. The pre-glued sheet is severed into strips of a width somewhat less than the circumference of the bushing holes, and a strip thus formed is pulled into the shaft holes in the fork member; as it is pulled in, the cloth becomes circumferential in the bushing holes with the glued surface engaging the wall surface of the holes. The felt is initially much thicker than its ultimate dimension in the bearing. The assembly is then heated sufficiently to melt the glue and cause it to adhere to the shaft hole surfaces. The fork member is then cut away from the cloth strip at the inner and outer faces of its arms. Pre-application of heat-sensitive glue to the felt simplifies the assembly process and results in uniform adhesion of the felt cylinder to the wall of the shaft hole.

According to another aspect of the bearing construction and its fabrication, the tight cylinders of bushing cloth in the arms of the fork are opened by a metal pin of approximately the diameter of the center pin to be used with the bearing, radially compressing the cloth cylinders to considerably denser condition. With the pin inserted, the assembly is dipped in water for a short time to permit the wool cloth cylinders to absorb moisture, and the assembly is thereafter allowed to dry. Because of the appreciable absorption of water by the wool cloth, and the confined condition imposed by the pin and the fork arm hole diameters of finite size, the cylinders are prevented from altering their dimensions with moisture absorption, and upon drying are set to this condition. Thereafter, with the pin still in place, the assembly is dipped in a fast-drying solution of resin bonded fluorocarbon solids for a short time, to permit the fluorocarbon solids to penetrate the wool cloth cylinders, mainly through the exposed ends thereof. The assembly is thereafter allowed to dry, after which the pin is removed; the wool felt cylinders remain "set" to the denser condition resulting from soaking in water and the resin bonded fluorocarbon particles, which impregnate an appreciable portion of the body of the felt cylinders, provide a high degree of lubricity and also forms a shell around the exterior surfaces of the wool cylinders which is substantially insensitive to changes in temperature and humidity.

BRIEF DESCRIPTION OF THE DRAWINGS

Further objects, features and advantages of the improved bearing and method of fabricating the same will become apparent from the following detailed description, taken in conjunction with the accompanying drawings, in which.

DETAILED DESCRIPTION OF THE INVENTION

Figure 1:
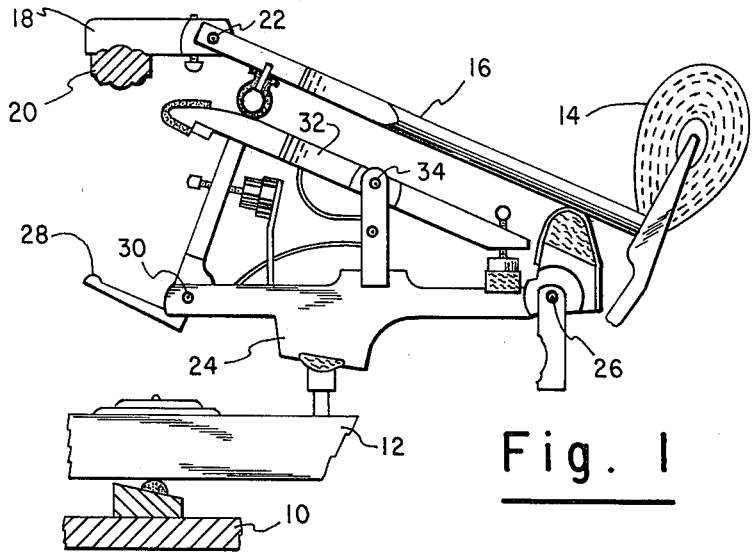
FIG. 1 is a fragmentary section of the front portion of a grand piano showing one key and its hammer action in side elevation to illustrate the hinge points at which the improved bearing is utilized.

The piano construction shown in FIG. 1 is conventional, consisting of a key-frame 10, key 12, hammer 14, hammer shank 16, hammer flange 18, flange rail 20, pivotal connection 22 between the hammer shank and hammer flange, support 24, support flange pivot 26, fly and tender 28, pivot 30 between support and fly, balancier lever 32 and pivot 34 between support and balancier lever. The improved bearing of this invention is usable to advantage in all of the pivotal connections 22, 26, 30 and 34, which are representative of such connections in actions of both upright and grand pianos. Since the bearings at all of these pivotal connections have the same construction, only the bearing 22 is illustrated in FIGS. 2, 3, 4 and 5.

Figure 2:
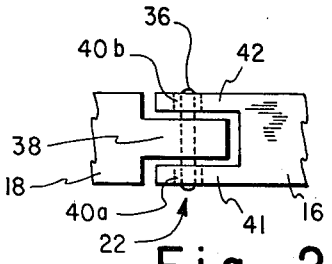
FIG. 2 is a fragmentary plan view on a larger scale of the forked end of the hammer shank and its flange connected by the improved bearing of this invention.

As seen in FIG. 2, the bearing 22 comprises a cylindrical metal pin 36, usually formed of "nickel silver", having a tight or driven fit with a hole extending laterally through the tongue portion 38 of the wooden hammer flange 18, both ends of the pin projecting beyond the sides of the tongues to form trunnions. Typically, the bearing pin has a diameter of $0.048 \pm 0.0002$ inch. These trunnions are surrounded by cylindrical bushings 40*a* and 40*b* fabricated of bushing or fabric cloth and retained, as by glueing, in bushing holes formed, as by drilling, in the arms 41 and 42 of the bifurcated or forked end of the wooden hammer shank 16, which holes for the indicated bearing pin diameter have a typical diameter of $0.1065 \pm 0.001$ inch. Thus, the hammer shank is pivoted to the tongue portion 38 of the hammer flange 18, the trunnion ends of the bearing pin 36 turning in the bushings 40*a* and 40*b*. The present invention simplifies the fabrication of and improves the performance and durability of such pivotal connections.

Figure 3:
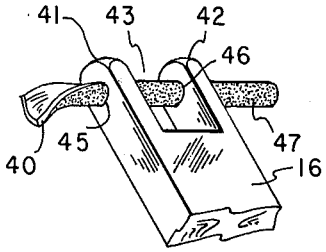
FIG. 3 is an exploded perspective view of the forked end of the hammer shank, illustrating the insertion of bushing cloth in the shaft holes thereof.
Figure 4:
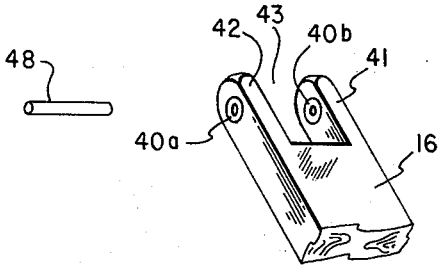
FIG. 4 is a perspective view of the hammer shank with the bushings in place in the shaft holes.

Referring to FIGS. 3 and 4, the hammer shank 16, taken as an example of the various flanges for supporting the rotatable parts shown in FIG. 1, is seen to have a pair of parallel leg portions 41 and 42 formed at one end which together define a hollow space 43 therebetween. The leg portions 41 and 42 are bored at the center with bushing holes 45 and 46 facing each other across the hollow space 43. Into these bushing holes is pulled a strip of bushing fabric or cloth 40, preferably felted wool bushing cloth, having a width somewhat less than the circumference of the bushing holes so that the cloth becomes circumferential in the bushing holes. The bushing felt is sufficiently thick that when rolled up into a cylinder during insertion, the resulting ill-defined axial opening herethrough is much smaller than the diameter of the bearing pin 36 to be used in the action.

An important aspect of the invention, which not only facilitates the step of inserting the felt strip into the bushing holes, but also contributes to the durability of the bearing over long periods of use, is that the surface of the bushing felt which constitutes the outer surface of the felt cylinder is pre-coated with a thin layer of heat-sensitive glue 45 of a type that is dry (i.e., is not tacky) until subjected to heat. In practice, a relatively large roll of bushing cloth is thinly coated with this type of glue, for example the #3424 Felt Heat Seal commercially available from T. H. Glennon Co., Inc., Lawrence, MA 01840, a water based glue containing 45% solids by weight. The glue is spread onto the bushing cloth, for example, with a doctor blade, in a film sufficiently thin that the natural nap of the fabric prevents complete glue coverage of the fabric. A sheet of the bushing cloth having a thus applied dried film of glue on one surface thereof is then severed into strips as described above, and the glue being dry, the cloth is readily drawn through the bushing holes in the arms 41 and 42; at the same time the somewhat unsatisfactory previously used step of applying liquid glue to the bushing cloth as it is drawn through the bushing holes is eliminated. Although FIG. 3 illustrates the strip being inserted into a single hammer shank, in commercial practice a multiplicity of shanks are supported side by side and a relatively long strip of pre-glued felt is pulled through the aligned bushing holes of all of the shanks in one continuous operation. The assembly (or assemblies) is then heated to a temperature of approximately 160° F. for a time sufficient to melt the glue and cause the outer cylindrical surface of the cloth to strongly adhere to the surface of the bushing hole. By virtue of the pre-application of the film of glue, there is uniform bonding of the cloth to the bushing hole surfaces, thereby to provide a more dependable adherence of the bushing cloth to the wooden arms than has been achievable by previously employed glueing methods. After the glue is firmly set, those parts of the bushing cloth not located within the shaft holes 45 and 46 are then cut off, so that bushings 40*a* and 40*b* are disposed in the bushing holes as shown in FIG. 4.

As has been previously noted, the thickness of the bushing cloth is such that upon becoming circumferential upon insertion in the bushing holes, the cylinders 40*a* and 40*b* comprise tight cylinders without any appreciable opening for the center pin. To provide space for the center pin, and to compress the bushing cloth to a denser condition, after the glue uniting these cylinders to the wall of the bushing openings has hardened, a metal "wetting" pin 48 having a diameter approximately equal to that of the center pin to be used with the bearing and a length approximately $\frac{1}{8}$" greater than the width of shank 16, is inserted along the axis of the bearing, radially compressing the cloth cylinders to a considerably denser condition. With the wetting pin in place, the assembly is dipped in water for a short time to permit the very absorptive wool cloth to absorb moisture, and is thereafter allowed to dry. Because of the confined condition imposed by the rod and the finite sized bushing holes, the cloth cylinders are prevented from altering their dimensions with moisture absorption, and upon drying are set to this condition. Thereafter, with the wetting pin still inserted, the assembly is dipped for a second time, for approximately three seconds, to a depth of at least the length of arms 41 and 42, in a fast-drying solution of resin bonded fluorocarbon solids, such as EMRALON 329 commercially available from Acheson Colloids Company, Port Huron, Mich. 48060, which is supplied as a concentrate of a thermoplastic resin dissolved in a solvent which, preparatory to use, is diluted in a ratio of 3:1 to 1:1 (product:diluent) with Acheson Thermoplastic Resin Extender, a selected blend of solvents also available from Acheson Colloids Company. In spite of the presence of the wetting pin, the fluorocarbon solids penetrate into perhaps 90% of the body of the now relatively dense wool cloth cylinders, mainly through their exposed end surfaces; indeed, the presence of the pin helps retain the integrity of the fibrous material (e.g., a large part of its natural nap) along the bore of the completed bushing. The assembly is thereafter allowed to dry, after which the wetting pin is removed; the wool cloth cylinders remain in the denser condition, to which they were "set" upon drying after immersion in water, and the resin bonded fluorocarbon particles from a shell around the cylinders which are then substantially insensitive to changes in temperature and humidity; that is, the shell tends to limit drying and shrinkage of the wool cloth under dry atmospheric conditions and at the same time substantially eliminates hygroscopic absorption of moisture when the bearing is subjected to moist environments. Additionally, the coating provides a high degree of lubricity and enhances the durability of the bearing. Although the integrity of the fibrous material along the bore of the bearings is retained by virtue of the wetting pin being in place during dipping in the fluorocarbon solution, it has been found that due, it is believed, to plastic flow of the EMRALON, the EMRALON at least partially coats the bore of the bearings to provide lubricity while still maintaining the fibrous character of the felted wool cloth. Piano action centers as completed have a desired firmness but yet are free with moderate radial force between the center pins and their bearing assemblies. The bearing assembly does not tighten up as do those with untreated wool felt bushings when the piano is played hard for extended periods.

Figure 5:
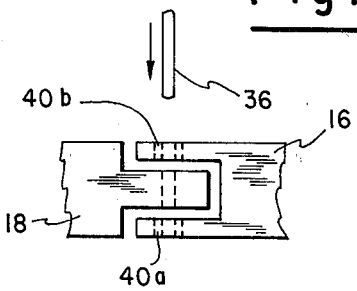
FIG. 5 is a fragmentary plan view illustrating the joining of the hammer shank and its flange by a pivotal connection.

FIG. 5 shows the joining of two piano action parts by a pivotal connection to form the complete assembly illustrated in FIG. 2. The smooth metal center pin 36, typically formed of "nickel silver" are pre-cut to proper length and tumbled to slightly round their ends, is driven—as indicated by the arrow—first into the bushing 40*b* in the arm 41 of the shank 16, then into a hole in the end of the interposed hammer flange 18 in which the pin fits tightly, and then into bushing 40*a* in the arm 42. In a complete grand piano about 600 pivotal connections or centers such as have been described would be employed, with a lesser number in an upright piano.

Although a bearing assembly having a center pin of a specific diameter has been described, it will be understood that this is by way of example only and that the advantages of the invention can be realized with bearing pins of other diameters. Also, while a particular heat-sensitive glue has been described, it is to be understood that this type of glue with acceptable characteristics may be available from other vendors. Likewise, although the described fast-drying solution of resin bonded fluorocarbon particles has proven to be eminently satisfactory, other solutions possessing the same or similar qualities may be used. It will be understood, therefore, that this and other modifications may be made without departing from the spirit of the invention, the scope of which is set forth in the following claims.

I claim:

1. A method of forming a bushing for a piano action assembly which comprises a bifurcated piano action member having parallel fork arms provided with mutually facing bushing holes and defining a hollow space therebetween, and a rotatable member having a tongue portion placed in said hollow space and provided with a shaft pin passing through said bushing holes of said fork arms, said method comprising the steps of:

(1) providing a strip of bearing material of a width somewhat less than the circumference of the bushing holes in said fork arms;

(2) pulling said strip of bearing material into said bushing holes and causing the strip to become circumferential in the bushing holes;

(3) adhesively securing the circumferentially positioned strip to the wall surface of the bushing holes;

(4) severing said bearing material adjacent the surfaces of said fork arms so as to retain only cylinders of bearing material in the bushing holes;

(5) inserting a pin of approximately the same diameter as said shaft pin into the bushing holes containing the cylinders of bearing material;

(6) with the pin inserted, dipping the fork arms in water to a depth sufficient to wet the bearing material, and thereafter drying the bearing material;

(7) with the pin still in place, dipping the fork arms in a solution of resin bonded fluorocarbon solids to a depth sufficient to wet the bearing material and for a time sufficient to permit penetration of the fluorocarbon solids into the bearing material, and thereafter drying the bearing material; and (8) thereafter removing said pin.

2. Method according to claim 1, wherein said bearing material is felted wool bushing cloth having a thickness such that when the strip is circumferential in said bushing holes the axial opening therethrough is much smaller than the diameter of said shaft pin.

3. Method according to claim 2, wherein the solvent of said the solution of resin bonded fluorocarbons is fast-drying, and the fork arms are dipped in said solution for approximately three seconds.

4. Method according to claim 1 or 2, wherein said strip of bearing material is coated on the surface that engages the wall surface of the bushing holes when the strip becomes circumferential with a thin film of dry heat-sensitive glue, and wherein the assembly of the strip of bearing material in said bushing holes is subjected to heat sufficient to soften said glue and cause the strip to adhere to the wall surface of the bushing holes.

5. Method according to claim 4, wherein the film of glue is sufficiently thin that the natural nap of the bushing cloth prevents complete glue coverage of the cloth.

6. Method according to claim 2, wherein said solution of resin bonded fluorocarbon solids is a fast-drying solution of Teflon particles marketed under the trademark EMRALON 329, and the fork means are dipped in said solution for approximately three seconds.

* * * * *